US010612269B2

(12) United States Patent
Parisien

(10) Patent No.: US 10,612,269 B2
(45) Date of Patent: Apr. 7, 2020

(54) FENCE SYSTEM

(71) Applicant: Harvey Parisien, Ottawa (CA)

(72) Inventor: Harvey Parisien, Ottawa (CA)

( * ) Notice: Subject to any disclaimer, the term of this patent is extended or adjusted under 35 U.S.C. 154(b) by 657 days.

(21) Appl. No.: 15/275,552

(22) Filed: Sep. 26, 2016

(65) Prior Publication Data

US 2017/0350158 A1 Dec. 7, 2017

(30) Foreign Application Priority Data

Jun. 3, 2016 (CA) ..... 2932078

(51) Int. Cl.
*E04H 17/14* (2006.01)
*E04H 17/22* (2006.01)

(52) U.S. Cl.
CPC ..... *E04H 17/1413* (2013.01); *E04H 17/1421* (2013.01); *E04H 17/22* (2013.01); *E04H 2017/1465* (2013.01); *E04H 2017/1491* (2013.01)

(58) Field of Classification Search
CPC ..... E04H 17/1421; E04H 17/22; E04H 2017/1465
USPC ..... 25/22, 24, 27, 65.02, 67, 73, DIG. 3; 52/300, 301
See application file for complete search history.

(56) References Cited

U.S. PATENT DOCUMENTS 3,918,686 A * 11/1975 Knott ..... E04F 11/181 256/21
4,050,828 A * 9/1977 Noro ..... E04F 11/1817 403/201
4,138,094 A * 2/1979 Thir ..... E04F 11/1834 256/67
4,188,019 A * 2/1980 Meredith ..... E04F 11/181 256/24
5,340,087 A * 8/1994 Turner ..... E04F 11/1834 256/59
5,702,090 A * 12/1997 Edgman ..... E04H 17/1421 256/19
5,787,664 A * 8/1998 Hollander ..... E04F 11/1836 256/65.11
5,904,343 A * 5/1999 Parth ..... E04C 2/20 256/19
6,398,193 B1 * 6/2002 DeSouza ..... E04H 17/1421 256/19
7,168,688 B2 * 1/2007 Davenport ..... E04H 17/1421 256/24
7,635,115 B2 * 12/2009 Lehmann ..... E04H 17/1443 256/19
7,677,000 B2 * 3/2010 Walker ..... E04F 11/1812 248/519
7,677,535 B1 * 3/2010 Lo ..... E04H 17/1443 256/22

(Continued)

FOREIGN PATENT DOCUMENTS

CA 2157325 A1 * 3/1997 ..... E04F 11/181

*Primary Examiner* — Joshua T Kennedy

(57) ABSTRACT

A fence system for receiving fence infill therein, wherein fence posts are arranged at selected locations along the fence as a first post and a second post. Upper and lower rails are positioned between the first post and the second post, to receive and restrict lateral movement of fence infill positioned therebetween, and are selectively movable and securable within the posts to permit vertical and angular adjustment of the upper rail and lower rail along the length thereof.

16 Claims, 13 Drawing Sheets

(56) References Cited

U.S. PATENT DOCUMENTS

| | | | | |
|---|---|---|---|---|
| 8,376,321 | B2 * | 2/2013 | Dotsey | E04F 11/1817 256/65.07 |
| 8,919,742 | B2 * | 12/2014 | Williams, Sr. | E04H 17/16 256/65.11 |
| 9,169,651 | B1 * | 10/2015 | Wynne | E04F 11/1834 |
| 2010/0237308 | A1 * | 9/2010 | Lo | E04H 17/1417 256/26 |
| 2013/0277634 | A1 * | 10/2013 | Munyon | E04H 17/1421 256/67 |
| 2014/0054530 | A1 * | 2/2014 | Petta | E04H 17/1421 256/67 |

* cited by examiner

FENCE SYSTEM

The present invention relates to a fence system, and, more particularly, to an improved fence system which allows for the vertical and angular adjustment of fence rails during installation and on a periodic basis to accommodate for variances in ground contours, or to natural or unnatural movement of the earth over time, while, at the same time, eliminating and substantially inhibiting any rot of the fence infill.

BACKGROUND OF THE INVENTION

Natural wood rail and post fencing is one of the most common types of fence, the installation and design of which has not really been altered for many decades. When installing a fence, of the type having a plurality of posts with fence rails spanned therebetween, the fence posts are typically installed and positioned in holes drilled into the ground and then sealed in place with concrete poured into these holes, such that a substantial length of each post is below the ground surface. In this manner, sideways movement of the posts are therefore substantially prevented. Once a plurality of such posts are installed, the fence rails are typically spanned therebetween. However, typical conventional fences do not readily provide for easy installation when faced with placement over ground surfaces having variances in ground contours, without the potential for leaving significant gaps at a lower end of the fence, and/or adverse soil conditions preventing the precise location of these post bases. Typical fence systems do not allow for vertical or angular adjustment of a previously installed fence system, particularly when the ground contours change over time with respect to, for example, erosion and/or frost conditions.

Moreover, traditional wooden fence posts and fence infill, over time, can be subject to rotting when exposed to weather conditions, which can weaken and compromise the fence structure.

It would therefore be advantageous to have an improved fence system which allows for more randomly placed posts, and elevation and angular adjustment of fence rails to accommodate variances in ground conditions, while, at the same time, substantially inhibiting any rot of the fence components.

It would also be advantageous to have an improved fence system which can be constructed and assembled without the use of nails when placement of the fence system occurs, and which can provide natural drainage of moisture by means of the vertical fence posts having portions thereof which are hollow. To this end, the present invention effectively addresses these needs.

SUMMARY OF THE INVENTION

The present invention provides the advantage of an improved fence system which eliminates rot of the vertical fence posts, and substantially inhibits rot of the fence system infill, when wood components are used.

The present invention also provides the advantage of an improved fence system which allows for the vertical and angular adjustment of fence rails to accommodate variances in ground contours, post locations and other situations effected by unpredictable soil conditions, and natural heaving of land due to frost or drought.

According to a broad aspect of an embodiment of the present invention, there is disclosed a fence system constructed and arranged to receive fence infill therein along a length of a fence, comprising a plurality of fence posts positioned at selected locations along the length of the fence, the posts being arranged at each of the selected locations as a first post and a second post; and an upper rail and a lower rail positioned between the first post and the second post, and constructed and arranged to receive and restrict lateral movement of the fence infill positioned therebetween, the upper rail and the lower rail being selectively movable along a length of the first post and the second post to permit vertical and angular adjustment of the upper rail and the lower rail.

According to another broad aspect of an embodiment of the present invention, there is disclosed a fence system constructed and arranged to receive fence infill therein along a length of a fence, comprising a plurality of fence posts positioned at selected locations along the length of the fence, the posts being arranged at each of the selected locations as a first post and a second post in opposed relationship to one another; an upper rail and a lower rail positioned between the first post and the second post, and constructed and arranged to receive and restrict lateral movement of the fence infill positioned therebetween; and a fence cap cover having a pair of longitudinally extending arms for covering upper ends of the first post and the second post, the arms being constructed and arranged for insertion within the first post and the second post, each of the arms having an adjustable securing mechanism thereon comprising an elongated slot and nut and bolt assembly, the nut and bolt assembly being movable within the elongated slot to permit selected vertical and angular adjustment of the fence rails during installation of the fence.

According to another aspect of the present invention, there is provided a method for manufacturing a fence constructed and arranged to receive fence infill therein along a length of a fence, the method comprising providing a plurality of fence posts for positioning at selected locations along the length of the fence, the posts being constructed and arranged for positioning at each of the selected locations as a first post and a second post; providing an upper rail and a lower rail for positioning between the first post and the second post, constructed and arranged to receive and restrict lateral movement of the fence infill positioned therebetween; providing for the upper rail and the lower rail to be selectively movable along a length of the first post and the second post to permit vertical and angular adjustment of the upper rail and the lower rail.

BRIEF DESCRIPTION OF THE DRAWINGS

The embodiments of the present invention will now be described by reference to the following figures, in which identical reference numerals in different figures indicate identical elements and in which.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

Figure 1:
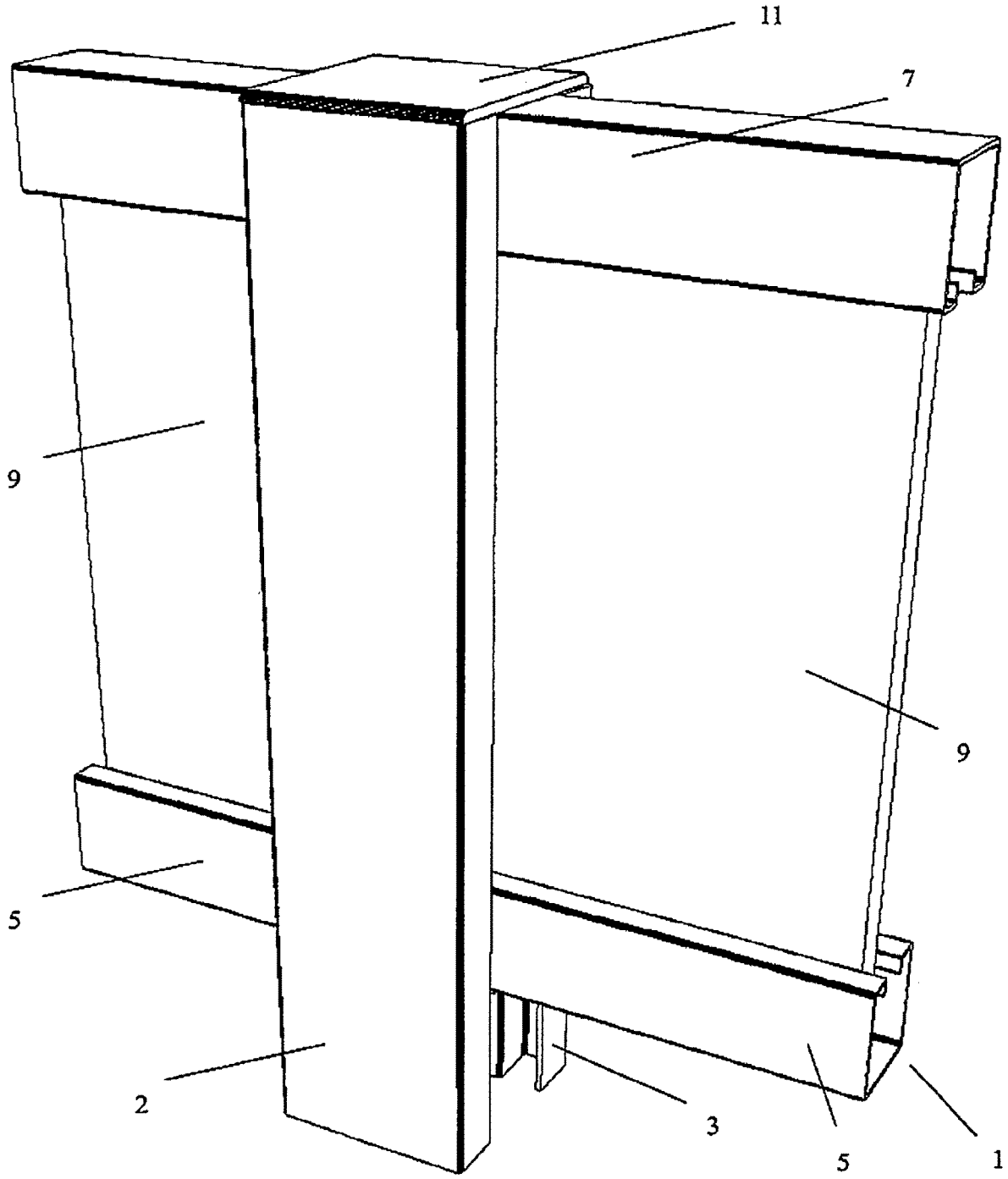
FIG. 1 is a side perspective view of the fence system of the present invention.

The present invention and advantages thereof are highly dependent on the 2 piece post concept shown in FIG. 1. Once these two pieces 2 and 3 (identical parts) are fastened together using the support brackets, it will be understood that the assembled result becomes a singular fence post.

The present invention consists of an improved fence system. Referring to FIG. 1, there is shown components of the fence system, shown generally at 1 in accordance with a first exemplary embodiment of the present invention.

Figure 6:
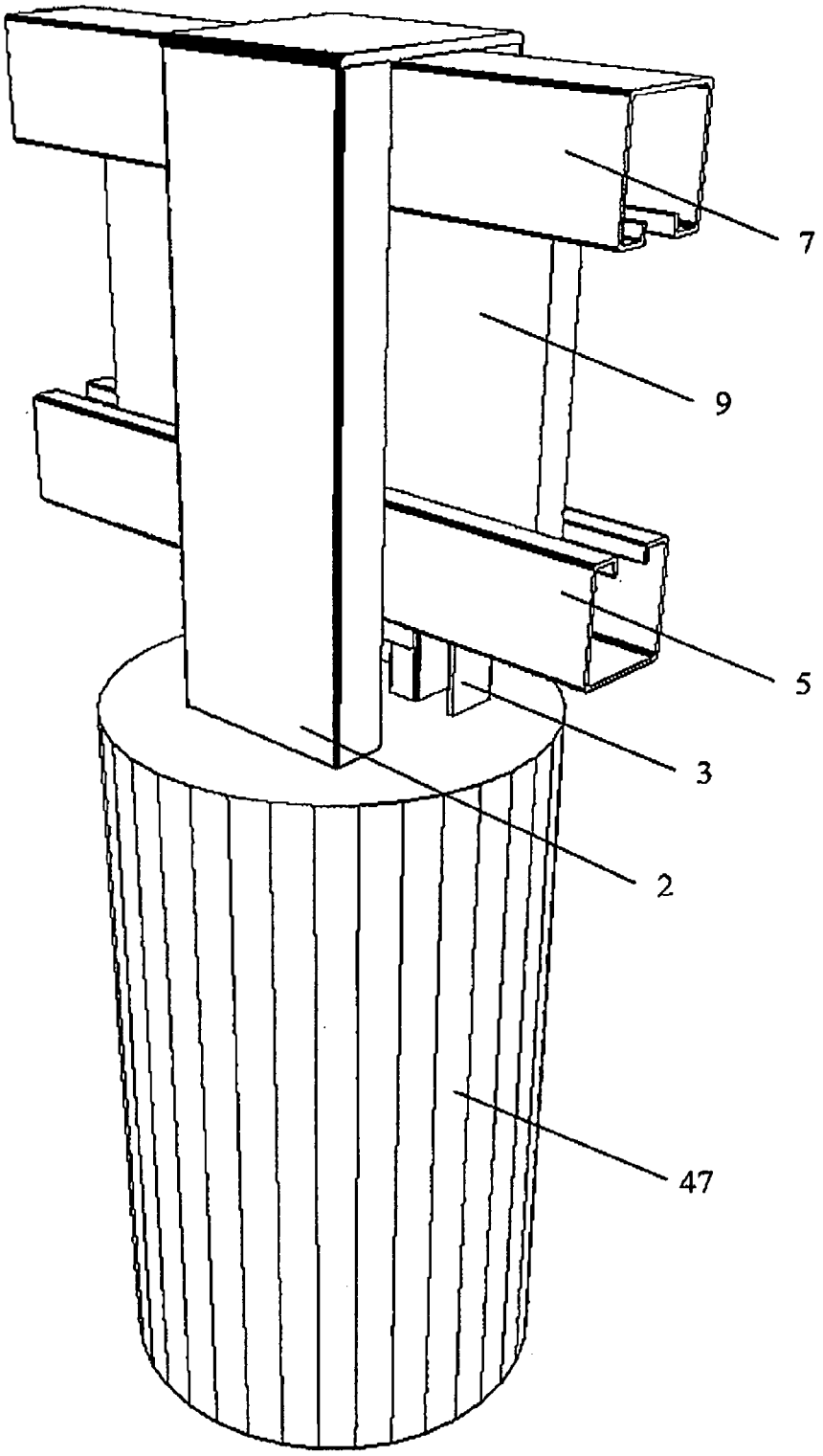
FIG. 6 is a side perspective view of the fence system of the present invention, illustrating the fence posts encased in concrete.
Figure 7:
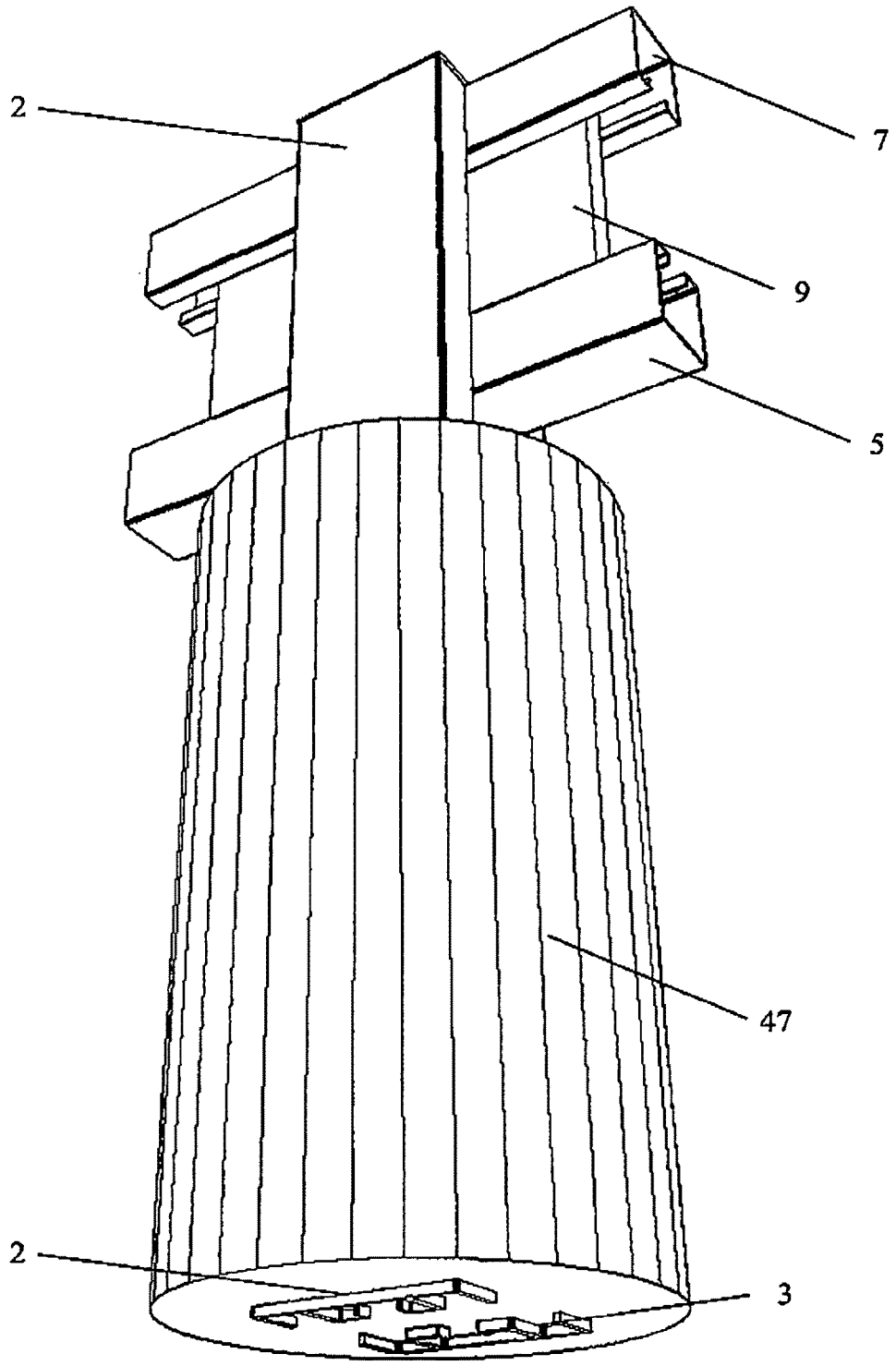
FIG. 7 is a bottom perspective view of the fence system of the present invention, illustrating the fence posts encased in concrete.

In this embodiment, as hereinafter described, upper rail 7 and lower rail 5 are mounted between opposed fence posts 2 and 3, and are used for supporting, and retaining therein, fence infill 9 positioned therebetween, it being understood that each fence post along the length of the fence structure will have upper rails and lower rails positioned therebetween. Generally, the fence structure will comprise numerous opposed fence posts at selected locations along its length. Of course, each fence post can be secured in holes drilled into the ground and then sealed in place (as an example only) with concrete, as shown in FIGS. 6 and 7.

Figure 5:
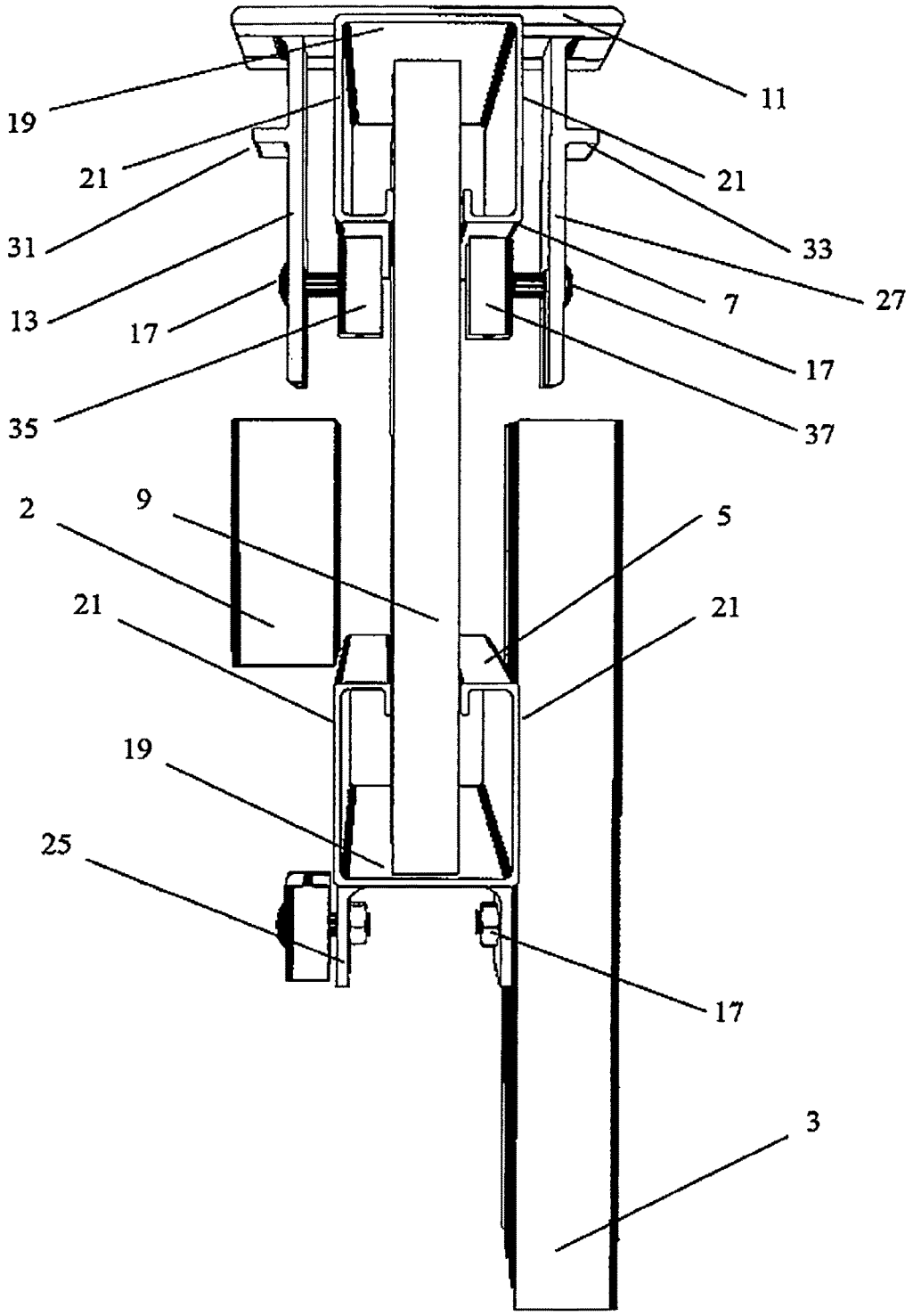
FIG. 5 is an end view of the fence system of the present invention shown in FIG. 1, illustrating portions of the fence posts in a cutaway view.
Figure 9:
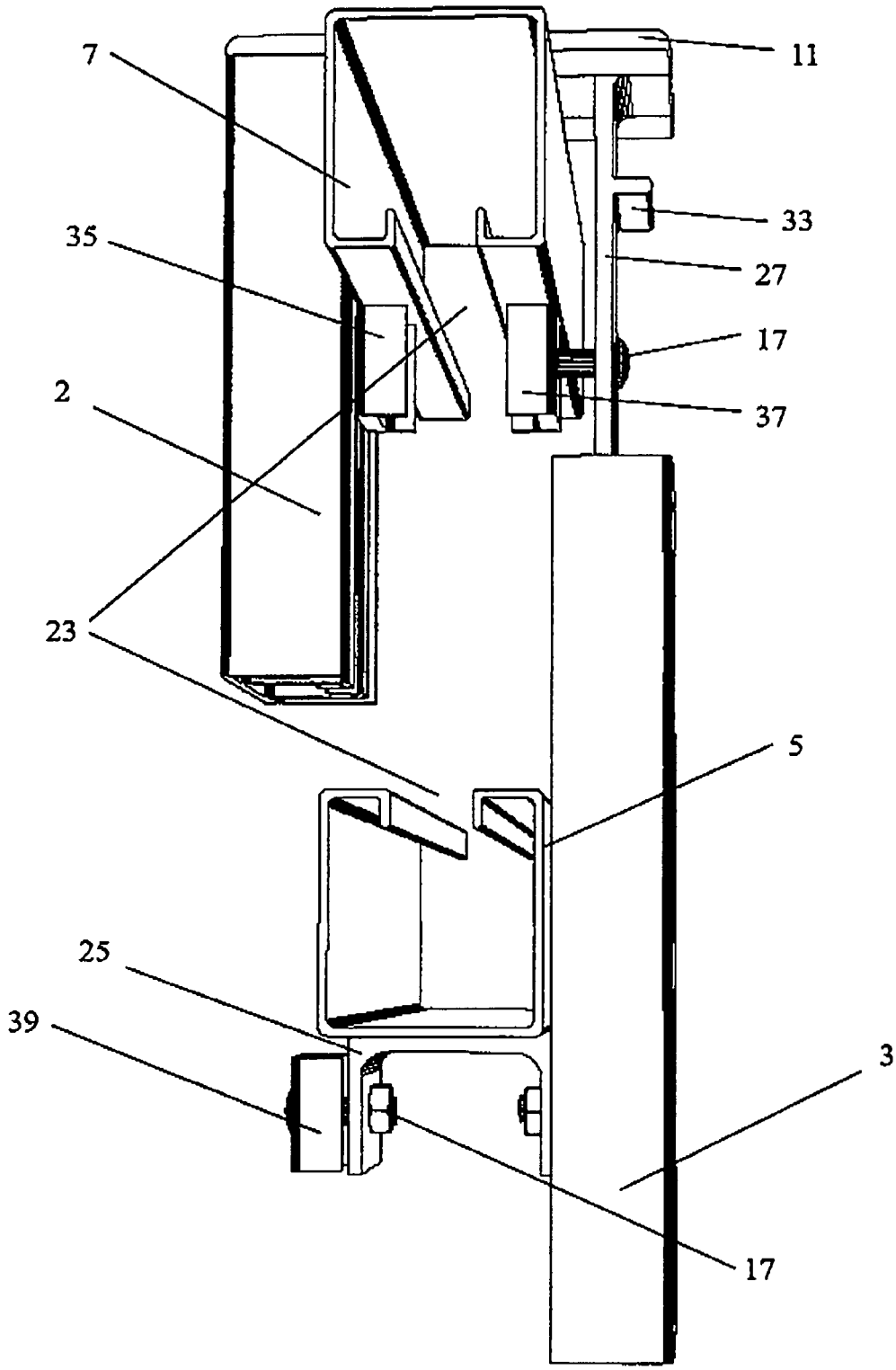
FIG. 9 is an end perspective view of the fence system of the present invention shown in FIG. 8, illustrating portions of each of the fence post in a cutaway view.

With reference to FIGS. 5 and 9, the upper rail 7 positioned between fence posts 2 and 3 rests on, and is supported by, securing blocks 35 and 37, which are interconnected with a nut and bolt assembly 17 inserted through longitudinally extending arms of fence cap cover 11, as will be later described. With reference to FIG. 9, lower rail 5 rests on, and is supported by, supporting bracket 25 which is mounted and interconnected to the fence posts, on each opposed end thereof, with a nut and bolt assembly 17 inserted laterally through mounting blocks 39 positioned within each of opposed fence posts 2 and 3. Once the nut and bolt assembly has been tightened, supporting bracket 25 can then securely support lower rail 5. Further, with respect to the upper rail 7, once the nut and bolt assembly has been tightened, securing blocks 35 and 37 move inwardly to tightly engage the fence infill 9 positioned between opposed fence posts 2 and 3, thus inhibiting and restricting lateral movement of the fence infill 9 within the fence structure when faced with elements such as wind.

Figure 4:
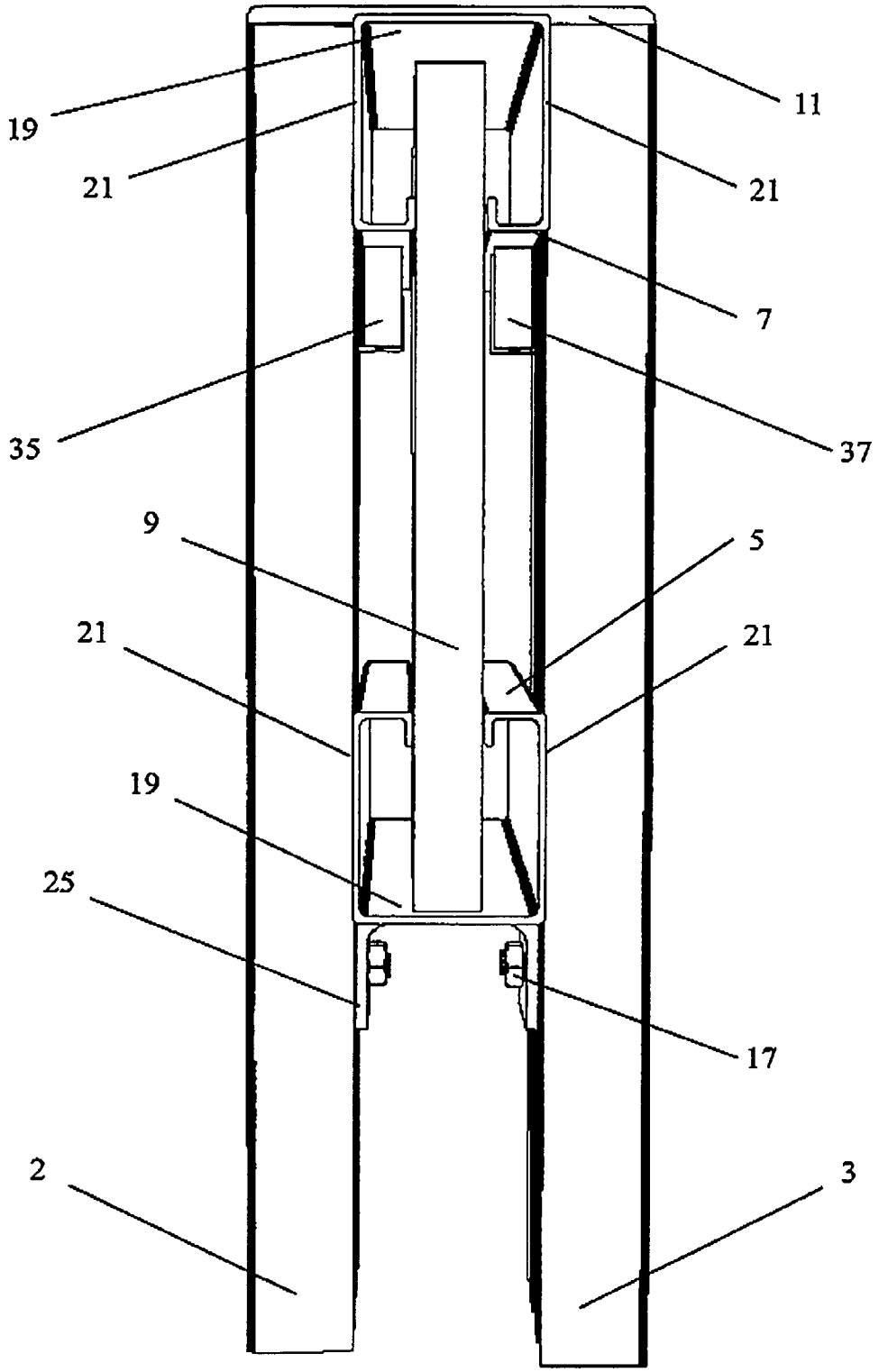
FIG. 4 is an end view of the fence system of the present invention shown in FIG. 1.

In an exemplary embodiment, the fence posts 2 and 3 and the upper rail 7 and lower rail 5 are comprised of aluminum extrusion material, though it will be understood that there could be numerous variations that could be utilized, as would be readily apparent to one skilled in the art. For example, such extrusion material could comprise, but is not limited to, plastic PVC, steel or various composites. With reference to FIG. 4, the upper rail 7 and the lower rail 5 will each have a horizontal surface 19 and a pair of opposed side walls 21 interconnected with the horizontal surface 19. With respect to the upper rail 7, these sidewalls 21 extend downwardly from the horizontal surface 19, while with respect to lower rail 5, these sidewalls 21 extend upwardly from the horizontal surface 19. In an exemplary embodiment, these sidewalls 21 are J-shaped side walls, distal ends of which define a channel 23 (as shown in FIG. 9) along a length of each of the upper rail 7 and the lower rail 5, within which the fence infill 9 are positioned. It will be understood that there could be numerous variations as to the shape of the distal ends of the side walls 21 that could be utilized, provided that there is an opening to receive the fence infill, as would be readily apparent to one skilled in the art.

Figure 2:
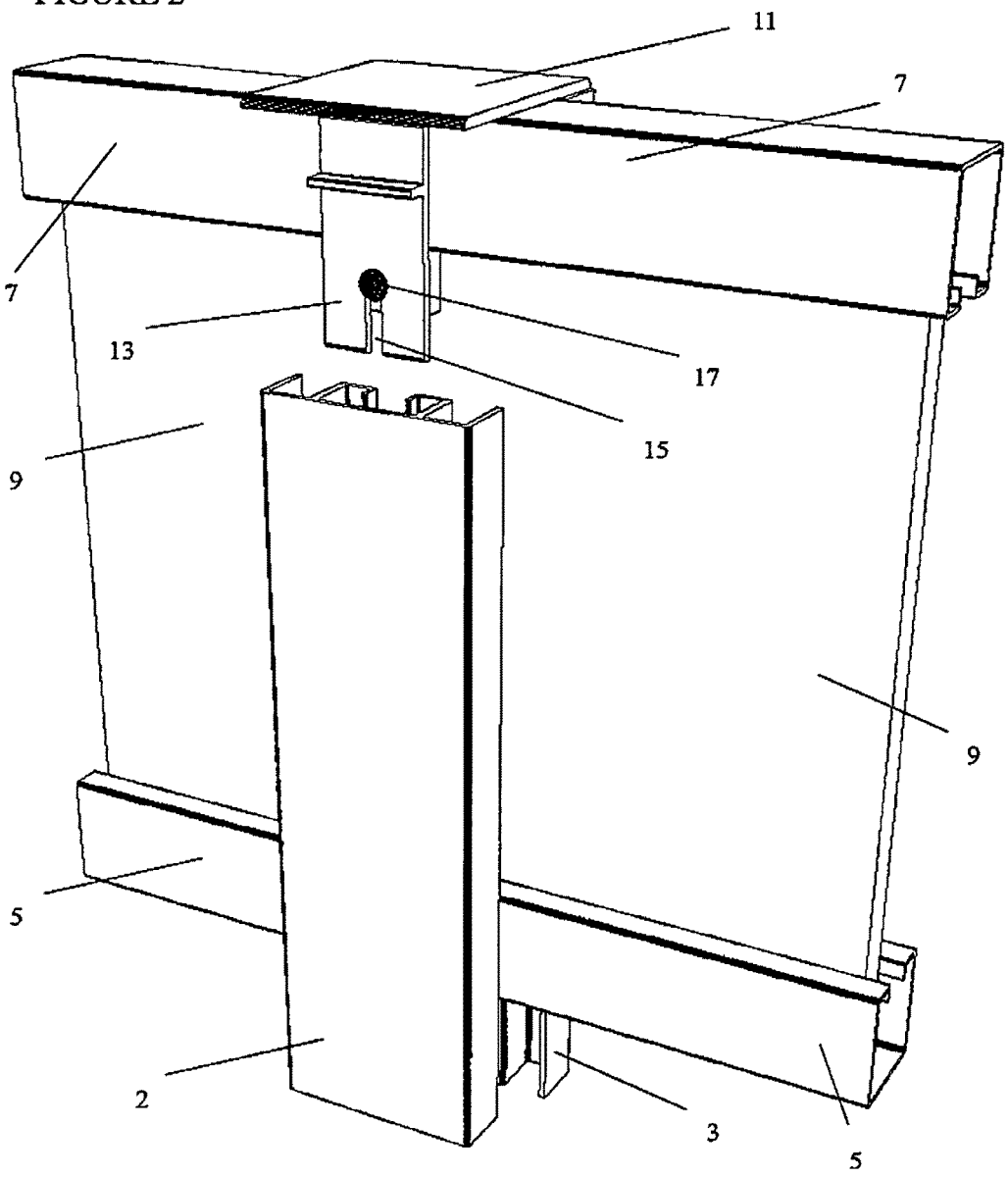
FIG. 2 is a side perspective view of the fence system of the present invention shown in FIG. 1, illustrating an upper portion of the fence post in a cutaway view.

Of course it will also be understood that the horizontal surface 19 of the upper rail 7 will comprise the upper surface of the horizontally extending fence structure, as can be seen in FIGS. 1 and 2, while the base portion of the lower rail 5 will comprise the lower surface of the horizontally extending fence structure, upon which fence infill 9 rests. Moreover, it will also be understood that there could be numerous variations as to the type of fence infill 9 utilized. For example, vertically positioned wooden rails could be used or aluminum panel sheets (each of which are shown in FIG. 2), or other types of materials, as would be understood by one skilled in the art.

Figure 3:
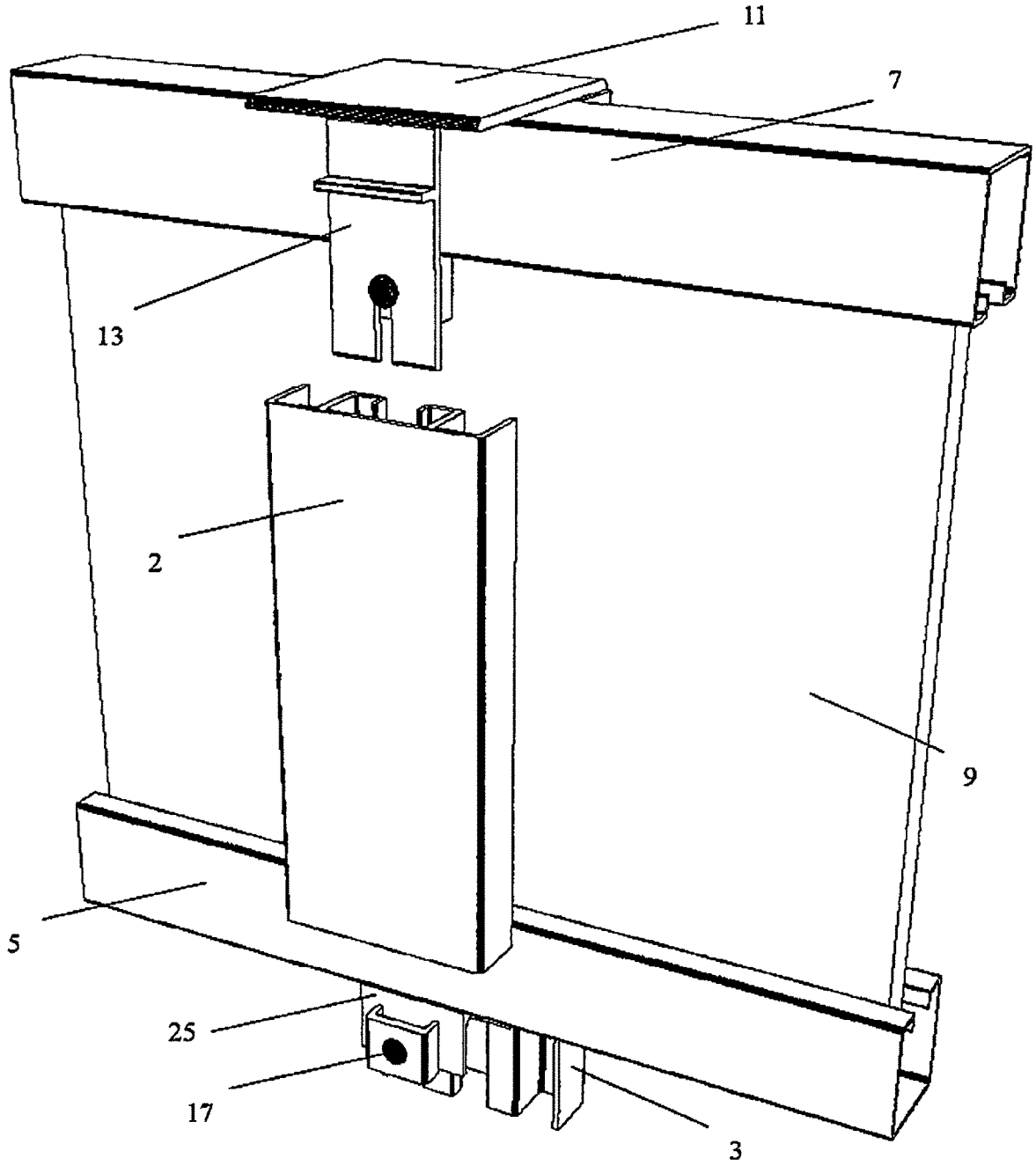
FIG. 3 is a side perspective view of the fence system of the present invention shown in FIG. 1, illustrating both upper and lower portions of the fence post in a cutaway view.

With reference to FIGS. 2 and 3, there can be seen a perspective view of the fence system of the present invention shown in FIG. 1, illustrating portions of a fence post in cutaway views. In FIG. 2, it can be seen that the fence system further comprises a fence cap cover 11 which is designed to cover each of opposed fence posts 2 and 3. As noted previously, and with further reference to FIGS. 5 and 9, fence cap cover 11 will have opposed longitudinally extending arms 13, 27 which are designed to be inserted and positioned within an upper end of the fence posts 2 and 3, connecting them together.

Distal ends of the lateral arms 13, 27 each define an elongated slot 15 therein, which is operably able to receive the nut and bolt assembly 17 for the upper rail 7. In this manner, when encountering variances in ground contours during installation of the fence system of the present invention, the nut and bolt assembly 17 can be adjusted or moved within elongated slot 15 to a selected desired position, and then secured, so as to allow for the vertical and angular adjustment of the upper rail 7 to accommodate variances in ground contours during installation (or to accommodate for periodic desired adjustment over time as ground conditions or fence conditions change) which is an important advantage of the present invention. Likewise, the supporting bracket 25 can be rotated to permit selective positioning of supporting bracket 25 to allow the lower rail 5 positioned thereon to be adjusted to attain a generally parallel relationship with any vertical adjustment effected to the upper rail 7. In this manner, over time, adjustment of the fence height can be undertaken as ground contours change (for example, as fence posts do move in the earth). Of course, the upper rail and the lower rail can each also be pivoted to provide for angular adjustments of each of the upper rail and lower rail, if desired and as necessary. Since most all conventional fencing systems have no adjustment system available to them, this is another important advantage of the present invention.

Figure 10:
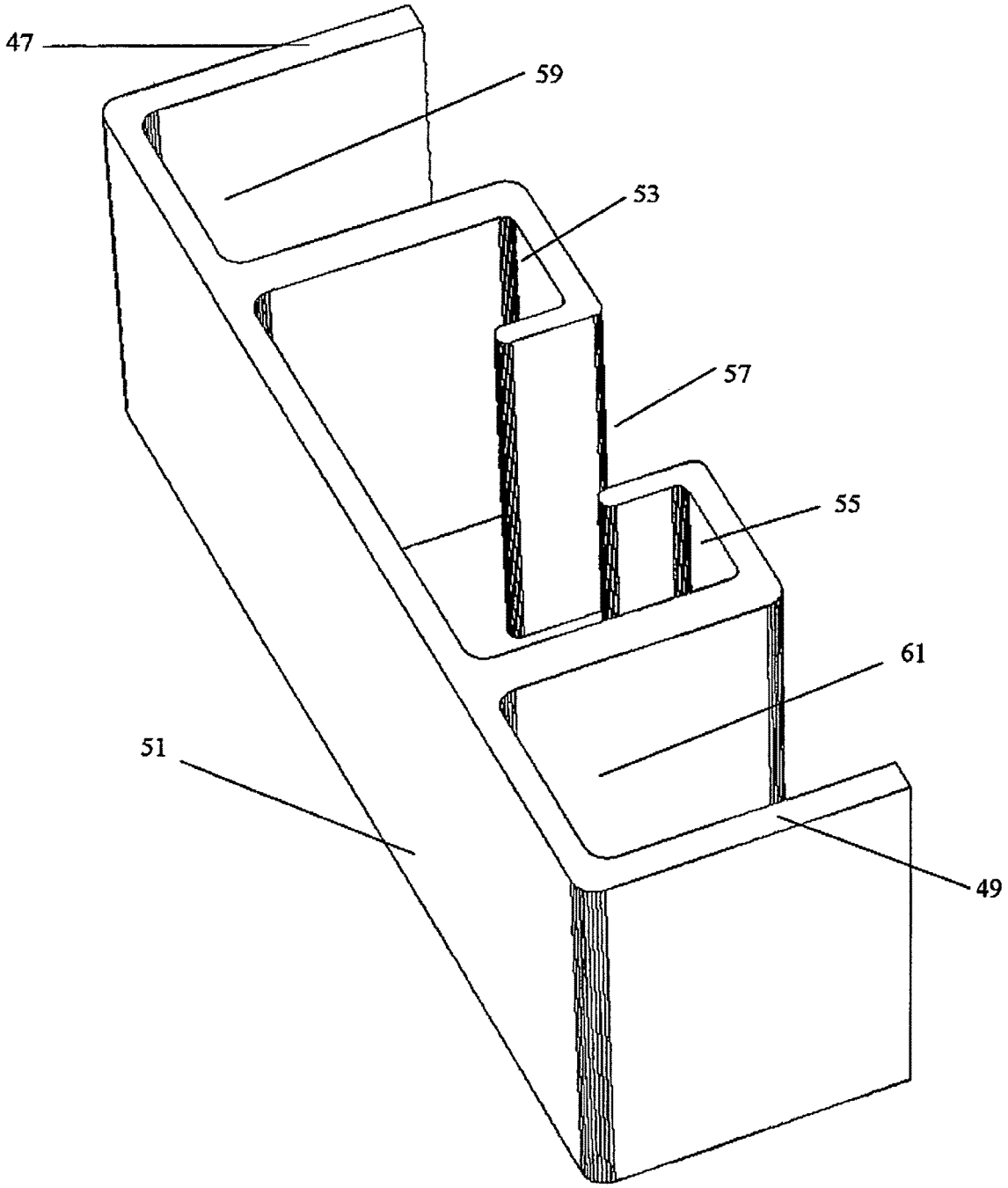
FIG. 10 is a top view of one of the two fence post pieces for use in the fence system of the present invention.

With reference to FIG. 10, which is a top view of each of the posts and its construction, the posts further comprise a base portion 51 having opposed first 53 and second 55 inner walls interconnected with the base portion 51 to define a receiving opening 57 therebetween. First and second end walls (47, 49, respectively) are also interconnected with the base portion 51 at outmost ends of the base portion 51. In this manner, a first channel 59 is created between the first end wall 47 and the first inner wall 53, and a second channel 61 is created between the second end wall 49 and the second inner wall 55. As FIG. 10 illustrates a top view, it will be understood that each of the base portion 51 and each of the walls noted above will extend along a complete vertical length of the posts 2,3 as shown in FIG. 1. In this manner, interior portions of the posts 2,3 due to the presence of the receiving opening 57 and the first channel 59 and second channel 61 therein, will be at least partially hollow. This prevents water from collecting within the system. It will also be understood that more than one support bracket for the posts 2,3 can be mounted if desired.

With respect to the placement of the fence cap cover 11 onto upper surfaces of the posts 2, 3 (and with reference to FIGS. 3 and 5), the fence cover cap 11 further comprises abutment members 31, 33 integrally connected to an outside surface of each of the arms 13, 27, whereby, when the fence cover cap 11 is inserted and positioned to cover the posts 2, 3, arm 13, 27 is inserted into the receiving opening 57 of post 2 and arm 27 is inserted into the receiving opening 57 of post 3 (as shown in FIG. 5). As the fence cover cap 11 continues to be inserted into the receiving openings 57, the abutment members 31, 33, are inserted into position to substantially cover the receiving opening 57 between the first 53 and second 55 inner walls. In this manner, by virtue of the placement of arms 13, 27 and abutment members 31, 33 in receiving openings 57 within the posts 2, 3, lateral movement of the posts 2, 3 is substantially inhibited.

Figure 12:
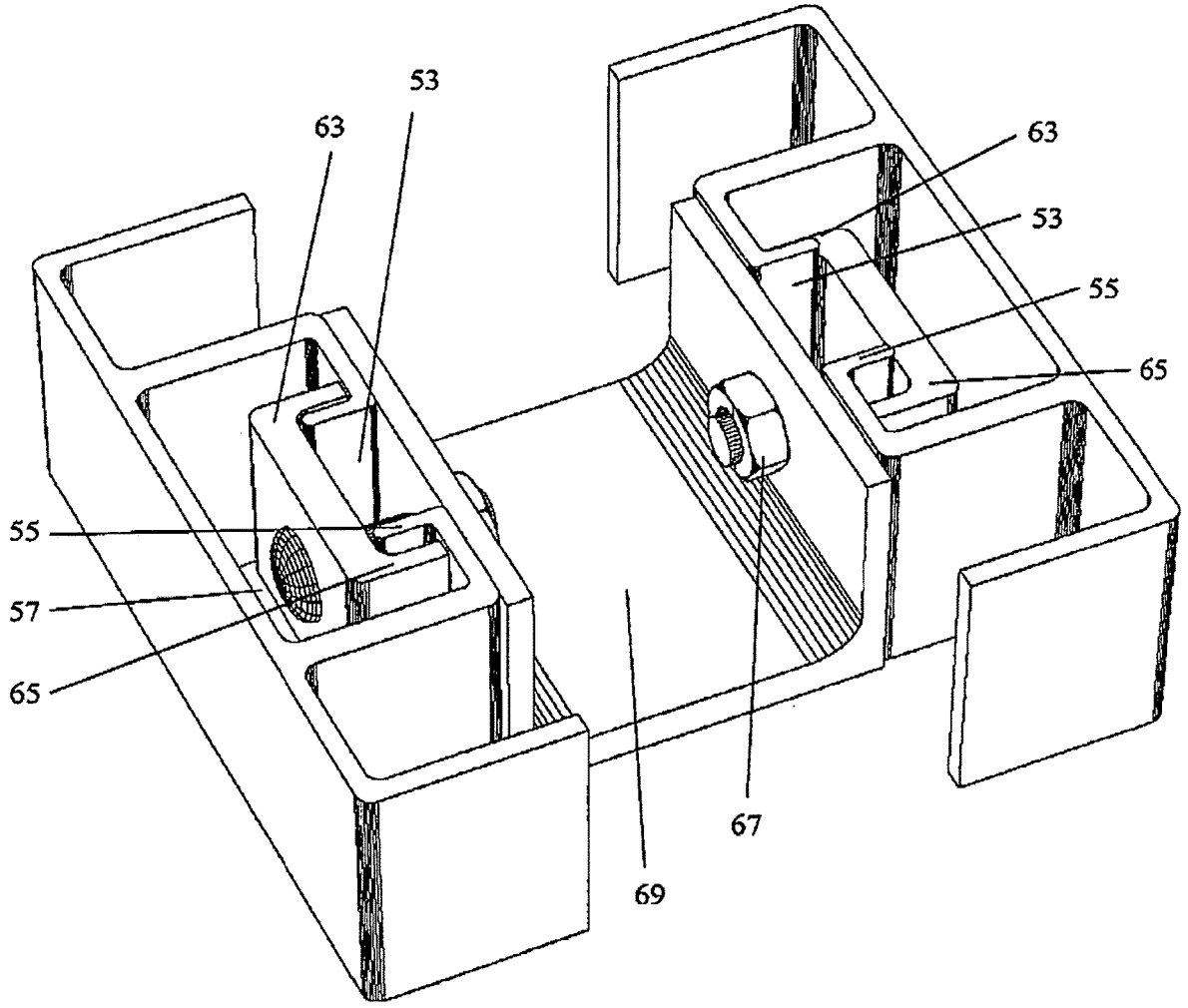
FIG. 12 is a top perspective view of a further embodiment of the present invention, illustrating an upper rail support bracket positioned between the posts.
Figure 13:
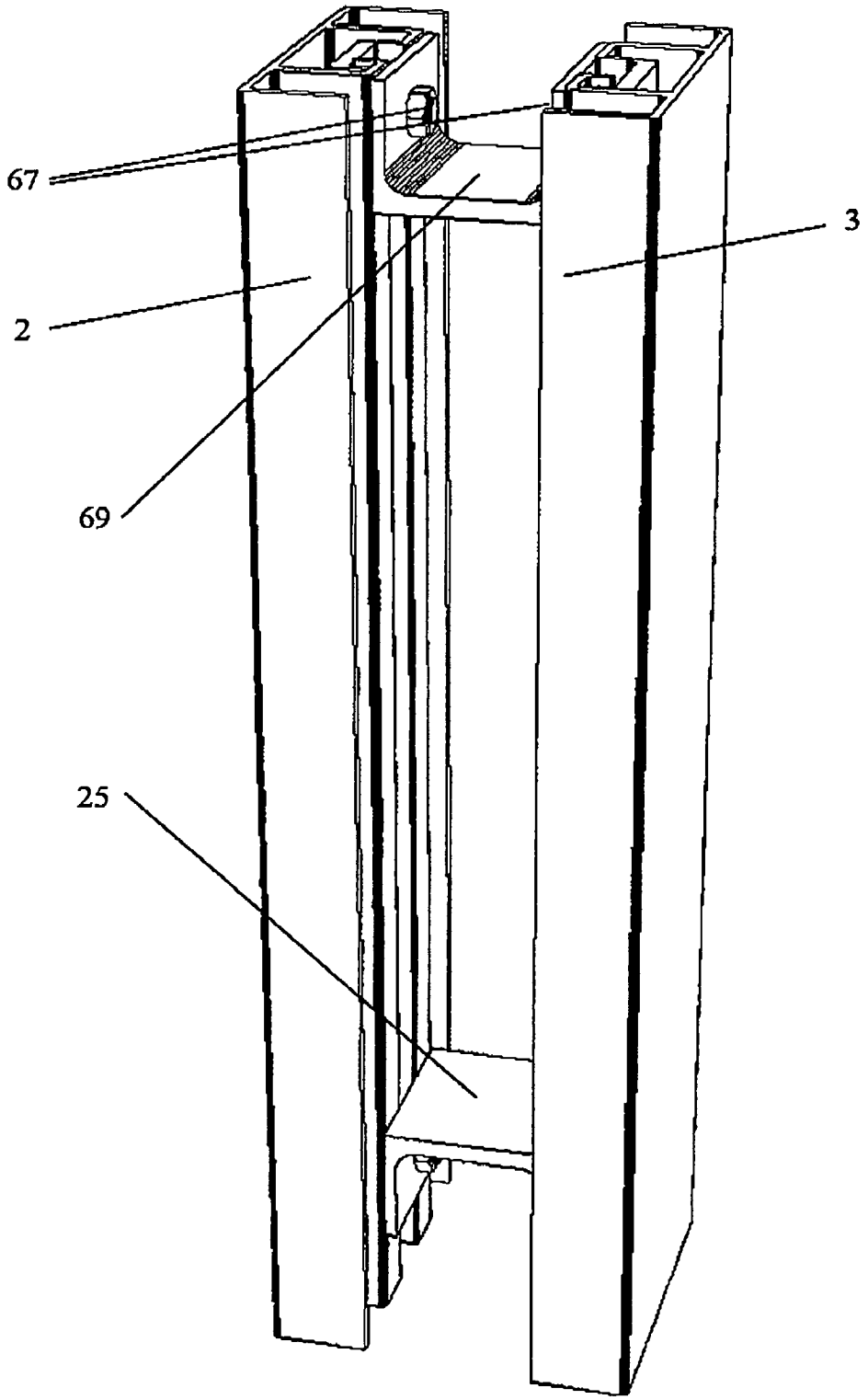
FIG. 13 is a top perspective view of the embodiment of the present invention shown in FIG. 12, illustrating the upper rail support bracket and supporting bracket positioned between the posts.

In another exemplary embodiment of the present invention, and with reference to FIGS. 12 and 13, which illustrates a top perspective view of an upper rail support bracket 69 for supporting upper rail 7 (not shown) positioned between posts 2,3 it can be seen that flanged portions 63, 65 of the upper support bracket assembly abut outside surfaces of the opposed first 53 and second 55 inner walls, and can be selectively movable and then secured in position within the receiving opening 57 (as seen in FIGS. 10 and 12) of each of the first post 2 and the second post 3 to permit vertical adjustment of the upper rail support bracket 69 along the length of the posts. All that is required is untightening of nut and bolt assembly 67, movement of the upper rail support bracket 69 to the desired position along the posts, then retightening of the nut and bolt assembly 67.

Figure 8:
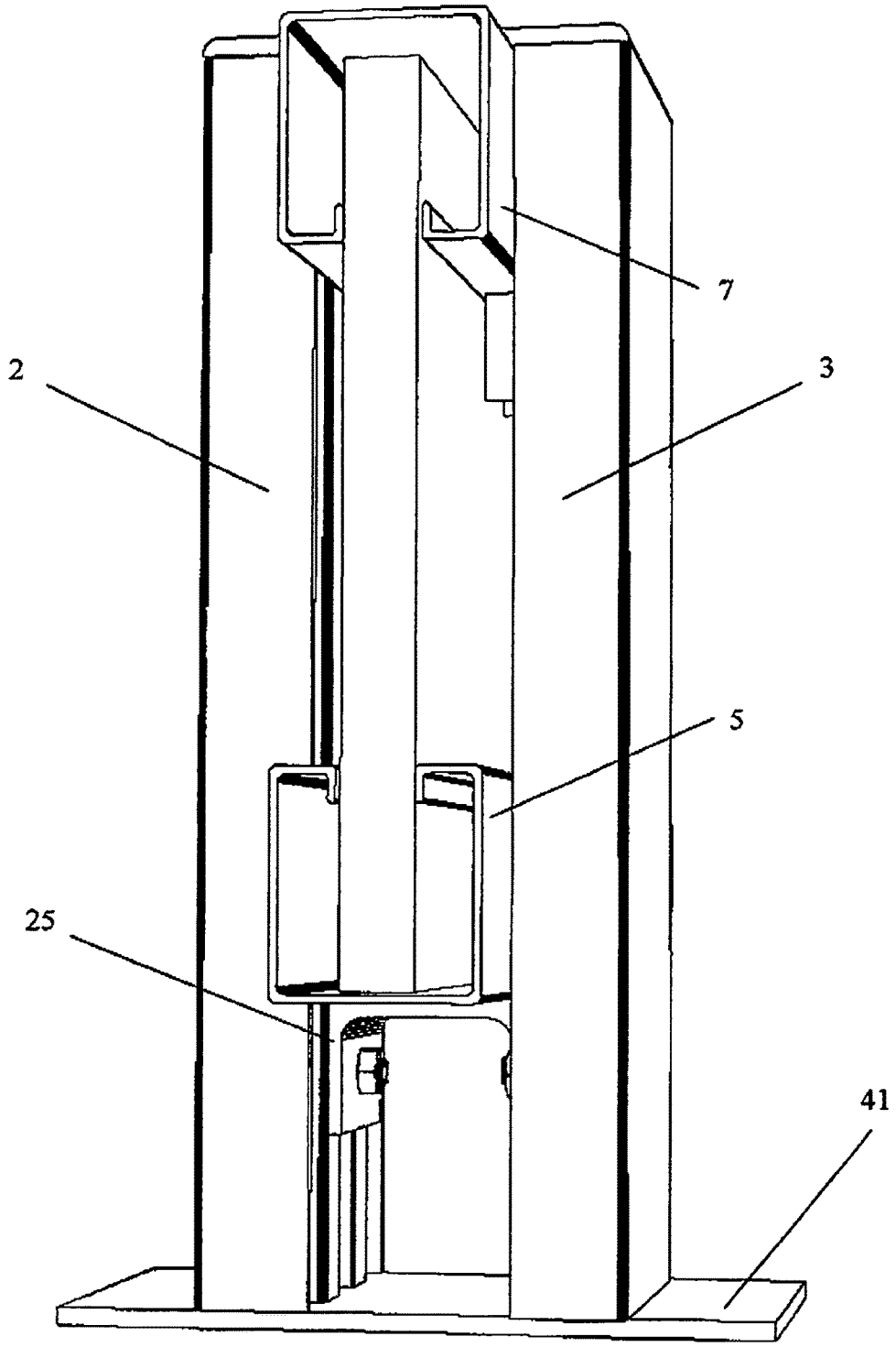
FIG. 8 is a side perspective view of an alternative embodiment of the fence system of the present invention.
Figure 11:
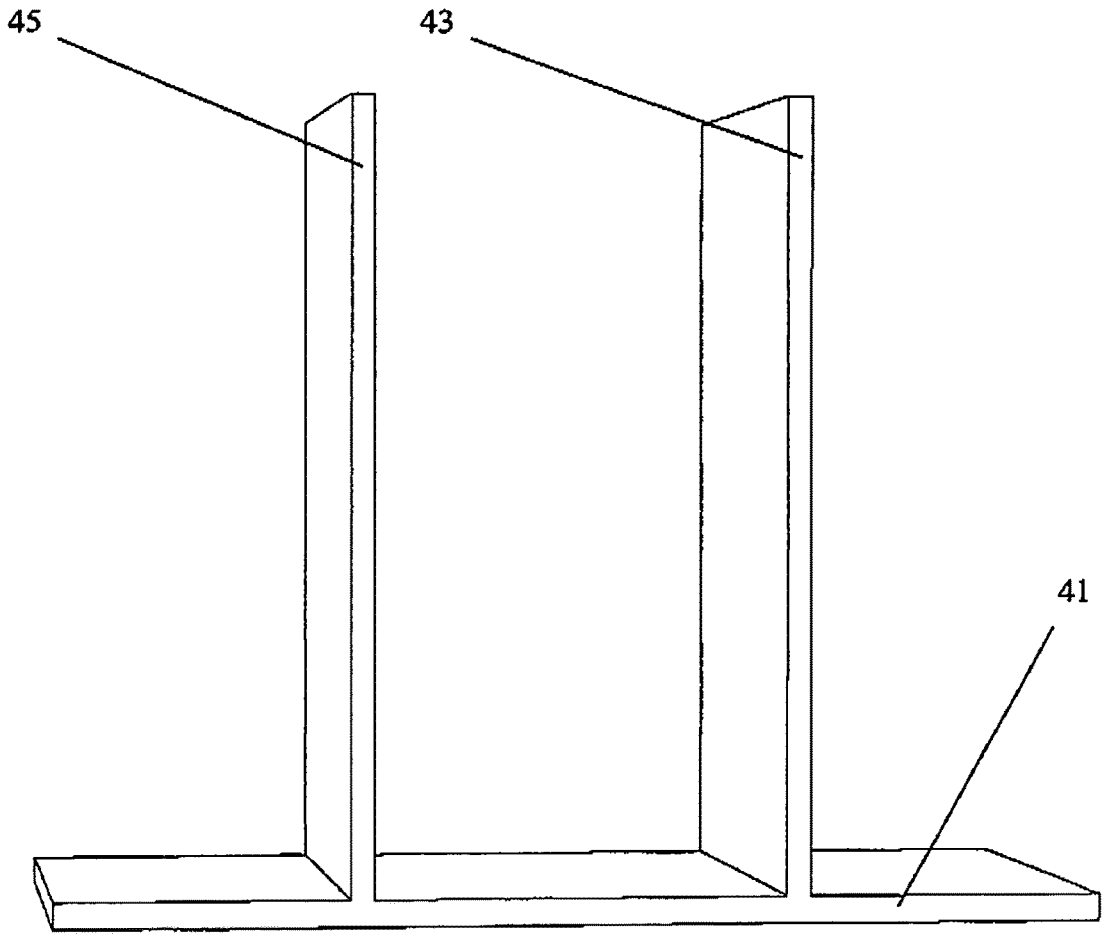
FIG. 11 is a side perspective view of a base component for use in the alternative embodiment of the fence system of the present invention shown in FIG. 8.

In a further embodiment of the present invention, shown in FIGS. 8 and 11, the fence system can further comprise a base stand 41, having two vertical insertion members 43 and 45, which can be inserted into, respectively, lower ends of the posts 2, 3, as shown in FIG. 8. More specifically, insertion members 43, 45 would be inserted into the receiving openings 57 within each of the posts 2, 3. As these insertion members 43, 45 are inserted from the lower end of posts 2, 3, they do not contact any of arms 13, 27 or abutment members 31, 33, as shown in FIG. 5 which are positioned towards an upper end within posts 2, 3, in the receiving openings 57. However, in this manner, insertion members 43, 45, once inserted, also serve to further inhibit and restrict lateral movement of the posts 2, 3 within the fence structure. Furthermore, in this manner of construction, it should be noted that base stand 41 would be connected to an existing surface (such as concrete), by means of securing bolts or the like drilled through the base stand.

It will be apparent to those skilled in this art that various modifications and variations may be made to the embodiments disclosed herein. Other embodiments consistent with the present invention will become apparent from consideration of the specification and the practice of the invention disclosed therein.

Accordingly, the specification and the embodiments are to be considered exemplary only, with a true scope of the invention being disclosed by the following claims.

We claim:

1. A fence system constructed and arranged to receive fence infill therein along a length of a fence, comprising:

a plurality of fence posts positioned at selected locations along the length of the fence, each post being arranged at each of the selected locations as a first post and a second post defining a receiving opening there between, wherein the first post and the second post further comprise a base portion, and opposed first and second inner walls defining a longitudinal slot and being interconnected with the base portion;

an upper rail and a lower rail positioned between each of the first posts and the second posts, and constructed and arranged to receive and restrict lateral movement of the fence infill positioned there between;

an upper support bracket and a lower support bracket mounted and interconnected between the first post and the second post, and supporting the upper and lower rails, respectively;

wherein the support brackets further comprise first and second nut and bolt assemblies engageable with the first post and the second post, respectively;

the first and second nut and bolt assemblies being movable within the longitudinal slots to a selected position and then secured to the first and second inner walls of the first and second posts, respectively, to permit the upper and lower rails to be selectively movable within the receiving opening of each of the first post and the second post to permit vertical and angular adjustment of the upper rail and the lower rail along a length of the first post and the second post.

2. The fence system of claim 1, wherein the fence posts and the upper rail and lower rail comprise extrusion material.

3. The fence system of claim 1, wherein the opposed side walls are J-shaped side walls.

4. The fence system of claim 1, wherein the first post and the second post are in opposed relationship to one another.

5. The fence system of claim 1, wherein the system further comprises a fence cap cover for covering and interconnecting upper ends of the first post and the second post.

6. The fence system of claim 1, wherein the first post and the second post further comprise a first and second end wall interconnected with the base portion at outmost ends of the base portion, and having a first channel between the first end wall and the first inner wall, and a second channel between the second end wall and the second inner wall, each of the base portion and the walls extending along a length of the posts.

7. The fence system of claim 6, wherein the first inner wall and the second inner wall are J-shaped side walls.

8. A fence system constructed and arranged to receive fence infill therein along a length of a fence, comprising:

a plurality of fence posts positioned at selected locations along the length of the fence, each post being arranged at each of the selected locations as a first post and a second post in opposed relationship to one another, wherein the first post and the second post further comprise a base portion, and opposed first and second inner walls defining a longitudinal slot and being interconnected with the base portion;

an upper rail and a lower rail positioned between each of the first posts and the second posts, and constructed and arranged to receive and restrict lateral movement of the fence infill positioned there between; and a plurality of fence cap covers corresponding to the plurality of fence posts, each fence cap cover is configured to cover upper ends of the first post and the second post, the cap cover further comprising a pair of longitudinally extending arms being constructed and arranged for insertion within the first post and the second post, each of the arms having an elongated slot therein;

first and second adjustable securing mechanisms supporting the upper rail, each comprising a nut and bolt assembly being selectively movable within a respective elongated slot to a selected position and then secured to the first and second inner walls of the first and second posts to allow for selected vertical and angular adjustment of the upper rail.

9. The fence system of claim 8, wherein the system further comprises at least one pair of securing blocks which are interconnected with the nut and bolt assembly, the blocks being positioned below the upper rail and inside the first post and the second post, and movable from an open position to a closed position in engagement with the fence rails.

10. The fence system of claim 8, wherein the system further comprises at least one supporting bracket mounted and interconnected between the first post and the second post, and beneath the lower rail.

11. The fence system of claim 10, wherein the at least one supporting bracket further comprises the elongated slot and nut and bolt assembly engageable with the first post and the second post, the nut and bolt assembly being movable within the elongated slot to permit selective movement of the at least one supporting bracket to permit the lower rail positioned thereon to be adjusted to attain a substantially parallel relationship with any vertical and angular adjustment effected to the at least the upper rail.

12. The fence system of claim 8, wherein the first post and the second post further comprise a base portion, opposed first and second inner walls interconnected with the base portion to define a receiving opening therebetween, and a first and second end wall interconnected with the base portion at outmost ends of the base portion, and having a first channel between the first end wall and the first inner wag, and a second channel between the second end wall and the second inner wall, each of the base portion and the walls extending along a length of the posts.

13. The fence system of claim 12, wherein the receiving opening of the first post is constructed and arranged to receive one of the arms of the fence cap cover, and the receiving opening of the first post is constructed and arranged to receive another of the arms of the fence cap cover.

14. The fence system of claim 8, wherein the fence cap cover further comprises an abutment member integrally connected to an outside surface of each of the arms, whereby, when the fence cap cover is inserted to cover the first post and the second post, the abutment member substantially covers the receiving opening between the inner walls so as to inhibit and restrict lateral movement of the first post and the second post.

15. A method for manufacturing a fence constructed and arranged to receive fence infill therein along a length of a fence, the method comprising:

providing a plurality of fence posts for positioning at selected locations along the length of the fence, each post being constructed and arranged for positioning at each of the selected locations as a first post and a second post defining a receiving opening there between;

providing the first post and the second post with a base portion, and opposed first and second inner walls defining a longitudinal slot and being interconnected with the base portion;

providing an upper rail and a lower rail for positioning between each of the first posts and the second posts, constructed and arranged to receive and restrict lateral movement of the fence infill positioned there between;

providing an upper support bracket and a lower support bracket mounted and interconnected between the first post and the second post, and supporting the upper and lower rails, respectively; wherein the support brackets further comprise first and second nut and bolt assemblies engageable with the first post and the second post, respectively;

the first and second nut and bolt assemblies being movable within the longitudinal slots to a selected position and then secured to the first and second inner walls of the first and second posts, respectively, to permit the upper and lower rails to be selectively movable within the receiving opening of each of the first post and the second post to permit vertical and angular adjustment of the upper rail and the lower rail along a length of the first post and the second post.

16. The method for manufacturing the fence of claim 15, further comprising the step of providing each of the upper rail and the lower rail with a base portion and a pair of opposed side walls interconnected with the base portion, distal ends of which define a channel along a length of each of the upper rail and the lower rail for receiving the fence infill therein.

* * * * *